United States Patent [19]

Kaneko et al.

[11] Patent Number: 4,614,090

[45] Date of Patent: Sep. 30, 1986

[54] OUTDOOR UNIT OF AN AIR CONDITIONER OF AN ENGINE HEAT PUMP TYPE

[75] Inventors: Teruji Kaneko; Toshihiko Kawabe; Moriyoshi Awasaka, all of Chayamachi, Japan

[73] Assignee: Yanmar Diesel Engine Co. Ltd., Osaka, Japan

[21] Appl. No.: 823,043

[22] Filed: Jan. 27, 1986

[30] Foreign Application Priority Data

Jan. 31, 1985 [JP] Japan ..... 60-15503
Oct. 8, 1985 [JP] Japan ..... 60-224523

[51] Int. Cl.[4] ..... G05D 23/32

[52] U.S. Cl. ..... 62/158; 62/175; 62/238.6

[58] Field of Search ..... 62/175, 158, 238.6, 62/238.7, 228, 4, 510; 237/2 B

[56] References Cited

U.S. PATENT DOCUMENTS 2,266,238 12/1941 Newton ..... 237/2 B X
3,648,479 3/1972 Richardson ..... 62/510 X
4,165,036 8/1979 Meckler ..... 237/2 B X
4,481,788 11/1984 Yoshino ..... 62/238.6 X
4,517,799 5/1985 Hanaoka et al. ..... 62/238.6 X

*Primary Examiner*—William E. Wayner
*Attorney, Agent, or Firm*—Burns, Doane, Swecker & Mathis

[57] ABSTRACT

An outdoor unit of an air conditioner of an engine heat pump type comprises an engine; first and second compressors driven by the engine and having substantially same capacity and heat exchangers for the compressors, said heat exchanger for the first compressor being adapted to utilize an atmosphere as a heat source in a heating operation, said heat exchanger for the second compressor being adapted to utilize a waste heat of the engine as a heat source in the heating operation, a rotation speed of the second compressor being set smaller than that of the first compressor in the heating operation, only the second compressor is adapted to operate in a defrosting operation for the heating operation while utilizing the waste heat of the engine as the heat source, said compressors being adapted to operate in a cooling operation and a rotation speed of the engine and a number of the compressors to be operated being controlled so as to control a cooling capacity in the cooling operation.

6 Claims, 24 Drawing Figures

H0
K0
M
B
Px
Py
H1
q1
q2
q3
q4
Q
Ja
P7
D
L
P8
J1
J2
P9
M1
M2
S1
V1
V2
V3
V4
V
F1
F2
P5
K
P4
J5
Jb
U
P10
P12
S2
P6
P3
O
P11
A
P1
C1
P2
C2
b1
b2
E
W1
R
W2
T2
W
T1
T11
Pm
G
Mn
T1
W1
W
t

OUTDOOR UNIT OF AN AIR CONDITIONER OF AN ENGINE HEAT PUMP TYPE

BACKGROUND OF THE INVENTION

The present invention relates to an outdoor unit of an air conditioner of an engine heat pump type, in which an engine is used for driving compressors of the air conditioner.

In a conventional air conditioner of a heat pump type, particularly for home use, an electric motor has been used to drive a compressor for compressing a cooling (heating) medium such as Freon (Trade Mark).

However, such air conditioners, which have been broadly used, have such a problem that electric power consumption is large, and, especially in a heating operation in a cold season, the electric consumption is very large because a heating efficiency of the heat pump is low.

In order to overcome the above problem, Japanese laid open publication No. 56-71773 has disclosed a heat pump air conditioner having a high energy efficiency, which includes two compressors driven by an engine, one of which is designated to have a compression ration smaller than that of the other so as to minimize the power consumption.

However, the above heat pump air conditioner can not disadvantageously perform defrosting operation during the heating operation in which a waste heat of the engine for driving the compressors is used as a heat source.

Further, in the conventional construction, since there is a difference between the pressures of the cooling medium in a heat exchanger for the outside air and a heat reclaimer for the engine, the two compressors are required, and thus, two accumulators for catching the liquid cooling medium are required for the compressors, respectively. Therefore, an accumulator system has been expensive.

Further, when the heat is excessively supplied from a cooling water to the cooling medium for utilizing the waste heat of the engine, the cooling water becomes relatively cold so that the engine may be over-cooled, which results in problems such as low durability of the engine, unstable combustion and large power loss. Moreover, in the over-cool condition, a large gap is formed between a piston and a cylinder liner in the engine, resulting in a large blowby gas, and, especially in a gas engine, resulting in such a problem that a large quantity of water is mixed into a lubricating oil.

Further, in the conventional construction, a complicated check valve arrangement is used in a piping arrangement.

Accordingly, it is an object of the invention to provide an improved outdoor unit of an air conditioner of an engine heat pump type, overcoming above-noted disadvantages, in which compressors can be driven by an engine with a small power consumption and a defrosting operation can be performed during a heating operation by utilizing a waste heat of the engine.

It is also an object of the invention to provide an improved structure, overcoming the above noted disadvantages relating to the accumulator, over-cooling and the check valve arrangement.

SUMMARY OF THE INVENTION

According to the invention, an outdoor unit of an air conditioner of an engine heat pump type comprises an engine; first and second compressors driven by the engine and having substantially same capacity and heat exchangers for the compressors, said heat exchanger for the first compressor being adapted to utilize an atmosphere as a heat source in a heating operation, said heat exchanger for the second compressor being adapted to utilize a waste heat of the engine as a heat source in the heating operation, a rotation speed of the second compressor being set smaller than that of the first compressor in the heating operation, only the second compressor is adapted to operate in a defrosting operation for the heating operation while utilizing the waste heat of the engine as the heat source, said compressors being adapted to operate in a cooling operation and a rotation speed of the engine and a number of the compressors to be operated being controlled so as to control a cooling capacity in the cooling operation.

DETAILED DESCRIPTION OF THE PREFERRED EMBODIMENT

Figure 1:
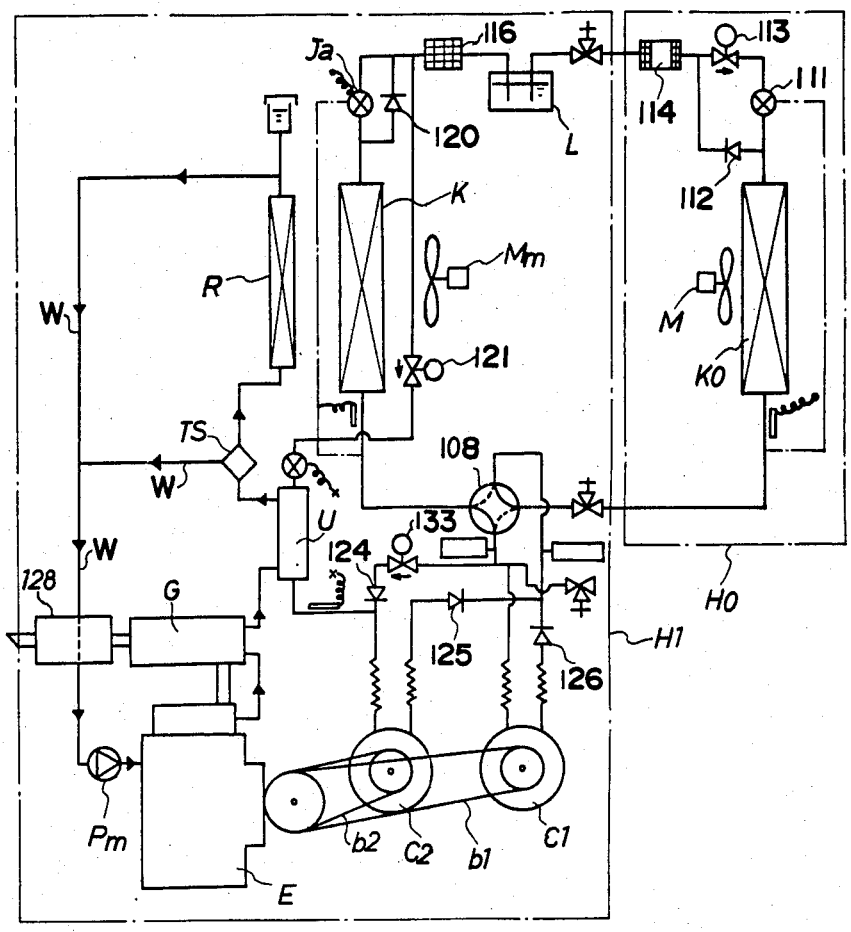
FIG. 1 is a diagram of an air conditioner of an engine heat pump type of an embodiment of the invention.

Referring to FIG. 1, an air conditioner of an embodiment comprises an indoor unit HO and an outdoor unit H1, which are illustrated by alternate long and short dash lines, respectively. The outdoor unit H1 includes first and second compressors C1 and C2, to which electromagnetic clutches (not shown) are associated, respectively. These compressors C1 and C2 have same capacity and are adapted to be driven by a common engine E by means of pulleys and V-belts b1 and b2, respectively.

The indoor unit HO includes a heat exchanger KO connected to a four-way valve 108 in the outdoor unit H1, a fan motor M, an expansion valve 111 for a cooling operation, a check valve 112, an electromagnetic valve 113 and a filter 114.

The outdoor unit H1 includes the engine E, a muffler 128, an exhaust gas heat exchanger G, a waste heat reclaimer U, a thermostat TS, a radiator R and a water pump Pm for supplying a cooling water to the engine E.

Further, the outdoor unit H1 includes a liquid receiver L, a filter 116, an expansion valve Ja for a heating operation, an outdoor heat exchanger K, a fan motor Mm for the exchanger K, a check valves 120, 124, 125 and 126 and an electromagnetic valves 121 and 133.

In FIG. 1, cooling medium lines are illustrated by solid lines, pressure equalizing lines are illustrated by alternate long and short dash lines and cooling water lines for the engine E is indicated by "W".

Figure 2A:
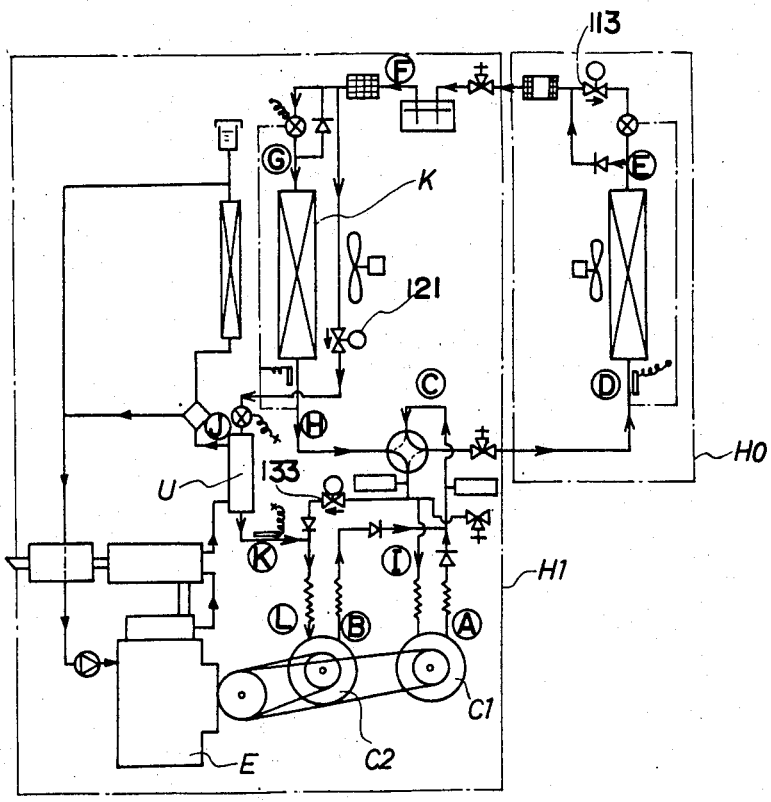
FIG. 2A is a diagram of the embodiment of FIG. 1 in a heating mode.

Operating modes of the above air conditioner will be described hereinafter. In a heating operation, as shown in FIG. 2A, an evaporator of the compressor C1 utilizes an outside air as a heat source through the heat exchanger H1, and an evaporator of the second compressor C2 utilizes a waste heat of the engine E as a heat source through the waste heat reclaimer U. The compressors C1 and C2 are driven by the engine in such a condition that a rotating speed Nc2 of the second compressor C2 is smaller than a rotating speed Nc1 of the first compressor C1.

The electromagnetic valves 133 and 113 are closed, and the valve 121 is open.

As described above, in the heating operation, the waste heat of the engine E is added to a heating energy through the medium.

Figure 2B:
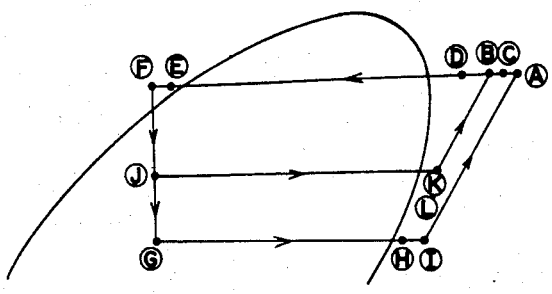
FIG. 2B is a graph illustrating pressure-enthalpy characteristics in the heating mode.

In the heating mode in FIG. 2A, pressure-enthalpy characteristics at various points are illustrated in FIG. 2B.

Figure 3A:
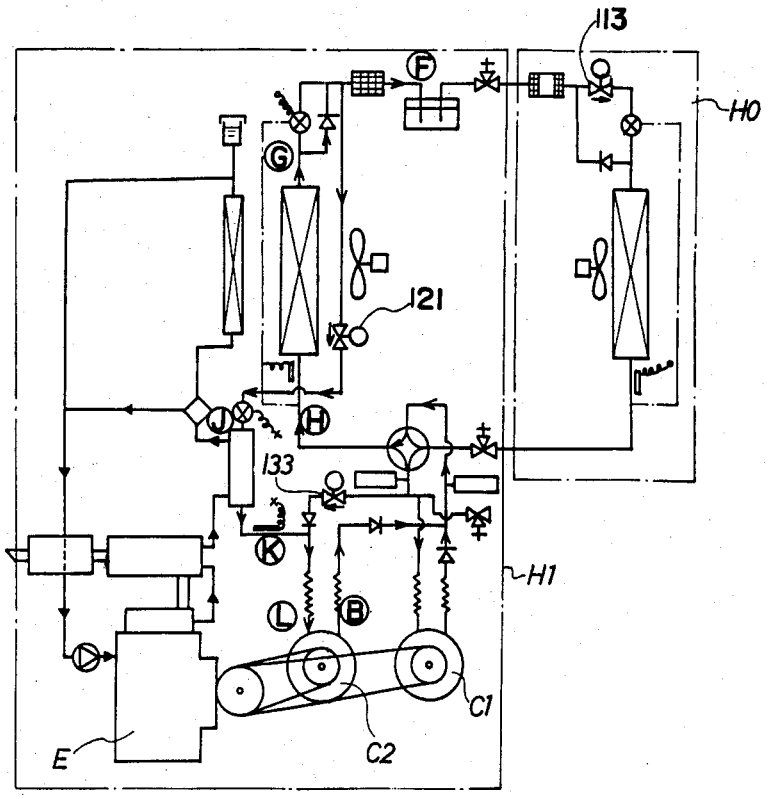
FIG. 3A is a diagram of the embodiment in FIG. 1 in a defrosting mode.

In a defrosting operation during the heating season in FIG. 3A, only the second compressor C2 is driven, and the waste heat of the engine E is utilized as the heat source for defrosting. In this operation, the valve 133 and 113 are closed and the valve 121 is open.

Figure 3B:
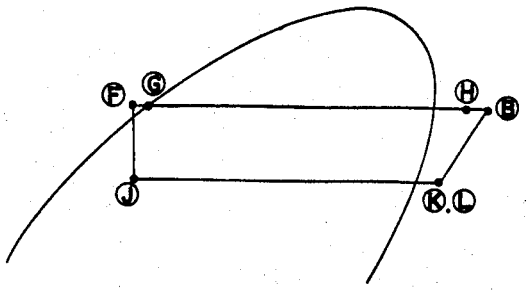
FIG. 3B is a graph illustrating pressure-enthalpy characteristics in the defrosting mode.

As described above, in the defrosting operation during the heating season, the waste heat of the engine E is utilized as the heat source for defrosting, and the pressure-enthalpy characteristics at various points are as illustrated in FIG. 3B.

Figure 4A:
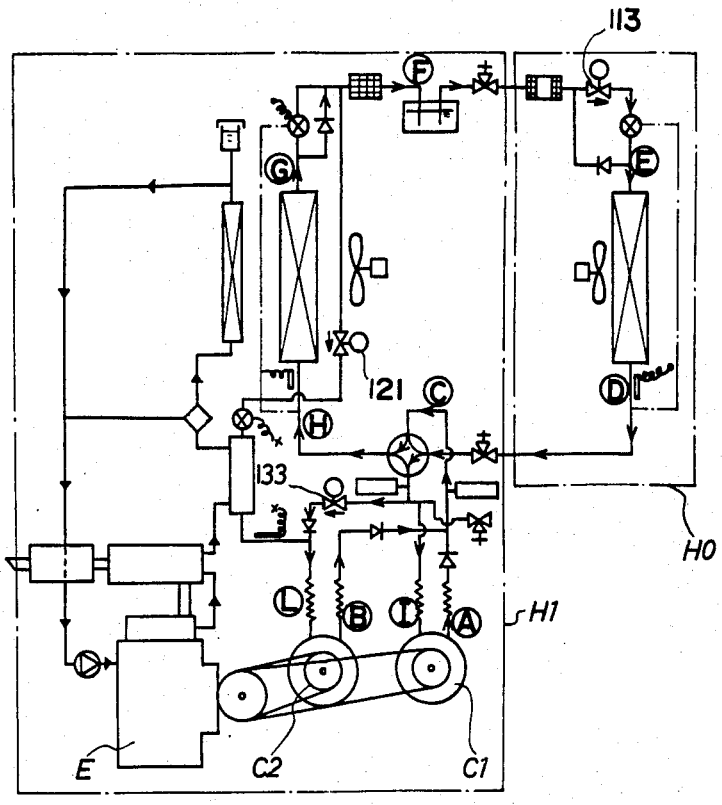
FIG. 4A is a diagram of the embodiment in FIG. 1 in a cooling mode in which two compressors are driven.
Figure 5A:
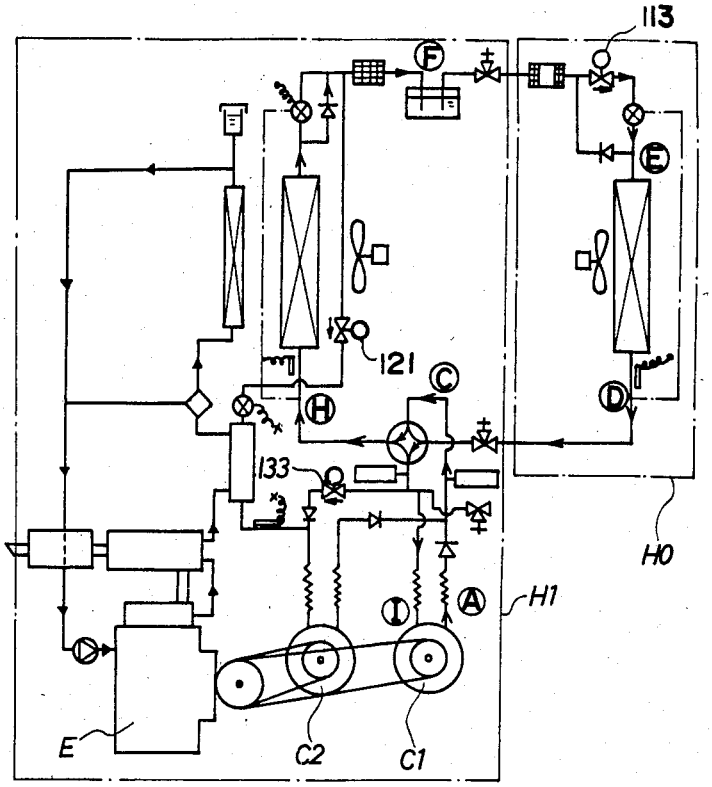
FIG. 5A is a diagram of the embodiment in FIG. 1 in a cooling mode in which only a first compressor is driven.
Figure 6A:
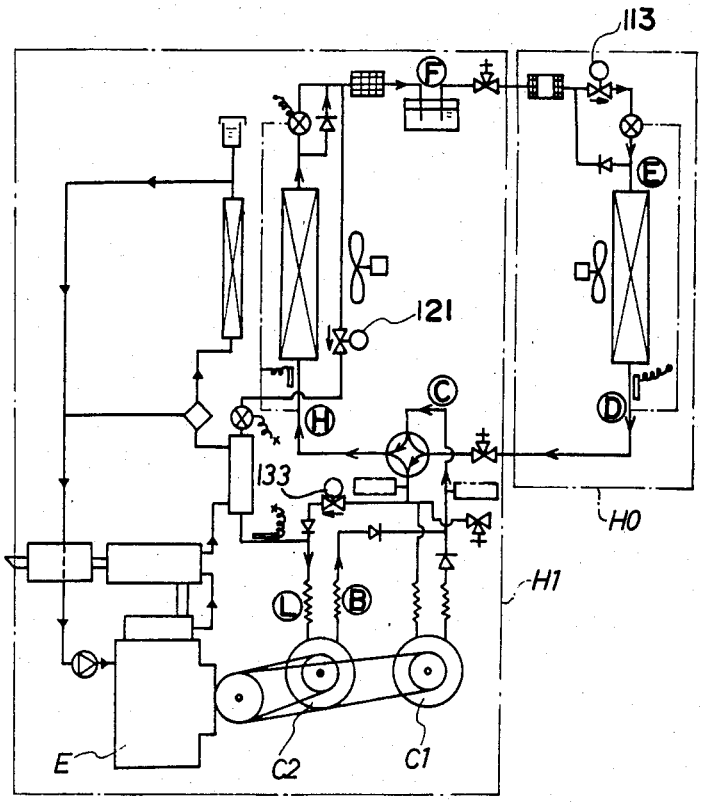
FIG. 6A is a diagram of the embodiment in FIG. 1 in a cooling mode in which only a second compressor is driven.

Referring to FIGS. 4A, 5A and 6A, in the cooling operation, the rotating speeds of the first and second compressors C1 and C2 are controlled, or a number of the driven compressors are controlled to control the cooling capacity, as described below.

Figure 4B:
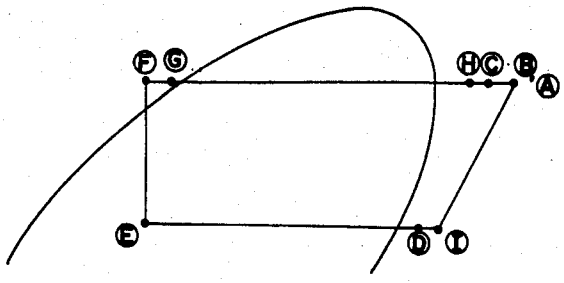
FIG. 4B is a graph illustrating pressure-enthalpy characteristics in the cooling mode in FIG. 4A.

In the operation in FIG. 4A, both compressors C1 and C2 are driven. The electromagnetic valves 133 and 113 are open and the valve 121 is closed. The pressure-enthalpy characteristics at various points in this operation are illustrated in FIG. 4B.

Figure 5B:
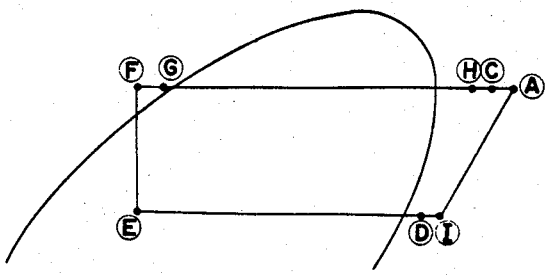
FIG. 5B is a graph illustrating pressure-enthalpy characteristics in the cooling mode in FIG. 5A.

In the operation in FIG. 5A, only the first compressor C1 is driven. The electromagnetic valves 133 and 121 are closed and the valve 113 is open. The pressure-enthalpy characteristics at various points in this operation are illustrated in FIG. 5B.

Figure 6B:
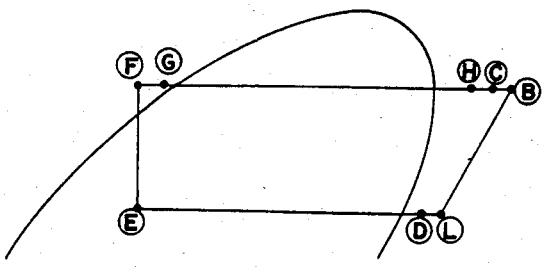
FIG. 6B is a graph illustrating pressure-enthalpy characteristics in the cooling mode in FIG. 6A.

In the operation in FIG. 6A, only the second compressor C2 is driven. The electromagnetic valves 133 and 121 are closed and the valve 113 is open. The pressure-enthalpy characteristics at various points in this operation are illustrated in FIG. 6B.

According to the air conditioner of the engine heat pump type of the present invention, since the waste heat of the engine can be added to the heating power through the medium, the indoor unit requires only a direct expansion coil for the cooling medium, and thus, does not require complicated structures. Further, since the waste heat of the engine can be sufficiently utilized, the heating capacity and the efficiency of the system are improved and the temperature of the outside air at which frosting starts on the outdoor unit can advantageously be low.

Since the waste heat of the engine can be utilized as the heat source in the defrosting operation during the heating season, a time required for the defrosting can be short and auxiliary equipments such as an electric heater, which have been necessary for an indoor unit of a conventional electric heat pump, are not necessary.

Further, in order to control the cooling capacity, the rotating speed of the engine can be controlled, and further, the number of the driven compressors is also controlled. Therefore, a control range of the capacity can be wide and a time of stating and stopping operation of the system can be reduced.

Other embodiment will be described hereinafter.

Figures 7, 8:
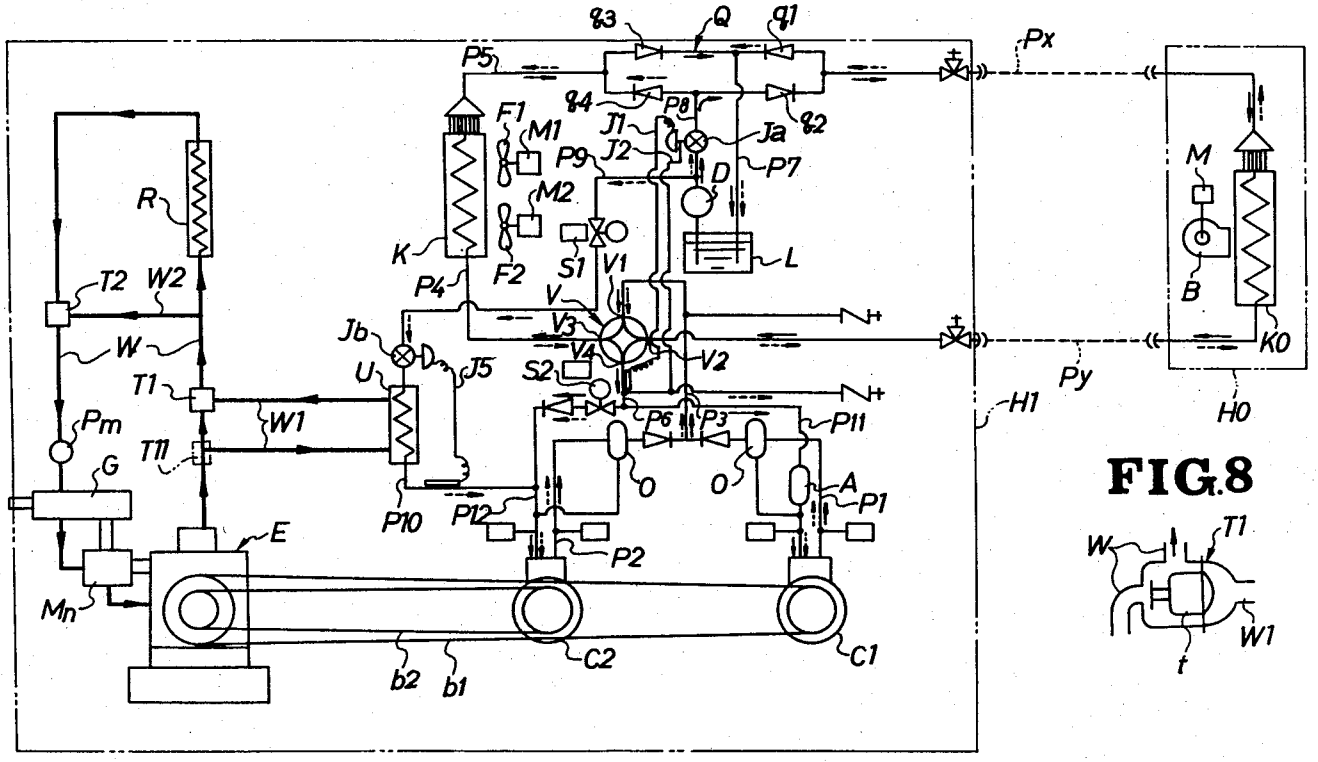
FIG. 7 is a diagram illustrating a layout of other embodiment of the invention.
FIG. 8 is a schematic sectional view of a thermostat in FIG. 7.

Referring to FIG. 7, arrows of solid lines indicate flow of a cooling medium such as Freon in a cooling operation and arrows of broken lines indicate the flow of the cooling (heating) medium in a heating operation. As show in FIG. 7, an air conditioner of an engine heat pump type comprises an indoor unit HO and an outdoor unit H1. The indoor unit HO includes a heat exchanger KO, cooling medium pipes Px and Py connected thereto and a fan or a blower B driven by a motor M. As will be described later, in a cooling operation, the cold cooling medium is supplied to the heat exchanger KO, so that an air supplied by the blower B is cooled by the heat exchanger KO when it passes therethrough, and then, flows into the room. In the heating operation, the hot medium is supplied to the heat exchanger KO, so that the air from the blower B is heated by the heat exchanger KO and flows into the room.

The outdoor unit H1 consists of a heat pump arrangement driven by a gas engine E, and comprises the engine E as well as first and second compressors C1 and C2, a heat exchanger K and others.

A cooling water of the engine E is adapted to flow in circulating passages W as indicated by arrows. These passages W are provided with a thermostat T1, a radiator R, a thermostat T2, a cooling water pump Pm, an exhaust gas heat exchanger G and a minifold Mn, which are arranged in this order from an upstream position to a downstream position. The thermostat T1 and the upstream portion thereto are connected by a bypass passage W1 in which a waste heat reclaimer U is arranged. The thermostat T1 itself has a well known structure. In the thermostat T1, as shown in FIG. 8, when the temperature of the cooling water is low, a valve body t occupies an illustrated position to ocnnect the downstream and upstream positions of the circulating passage W. When the temperature of the cooling water increases, the valve body t moves leftward in FIG. 8 so that an outlet of the bypass passage W1 is connected to the downstream position of the circulating passage W and the upstream position of the circulating passage W is closed.

The thermostat T1 may be eliminated, and, as illustrated by alternate long and short dash lines in FIG. 7, a thermostat T11 which operates similarly to the thermostat T1 may be arranged at a connecting point of the upstream end of the bypass passage W1 and the circulating passage W.

The thermostat T2 is arranged at a position downstream to the radiator R. A bypass passage W2 is provided to connect a position upstream to the radiator R and the thermostat T2. This thermostat T2 is designed to prevent the flow of the cooling water to the radiator R when the cooling water is cold.

The exhaust gas exchanger G is designed to cool an exhaust gas of the engine E by the cooling water. The manifold Mn is also designed to be cooled by the cooling water.

Driving shafts (input shafts) of the compressors C1 and C2 are connected through electromagnetic clutches (not shown), pulleys and belts b1 and b2 to an output shaft of the engine E, respectively.

Outlet pipes P1 and P2 of the compressors C1 and C2 are connected through oil separators O check valves and a common pipe P3 to a connection V1 of the four-way valve V. Among other three connections V2, V3 and V4 of the valve V, the connection V2 is connected to said pipe Py for the indoor heat exchanger KO, the connection V3 is connected to a pipe P4 of the outdoor heat exchanger K and the connection V4 is connected to a inlet pipe P6 of the compressors.

Two fans F1 and F2 driven by motors M1 and M2 are associated to the heat exchanger K.

Other pipes Px and P5 of the indoor and outdoor heat exchangers KO and K are connected to connections of a check valve arrangement Q. The check valve arrangement Q consists of four check valves q1–q4 which are assembled together, and has said two connections as well as other two connections to which an inlet of a pipe P7 and an outlet P8 are connected, respectively.

The outlet of the pipe P7 and the inlet of the pipe P8 are connected to a liquid receiver L. A drier D is disposed at a portion of the pipe P8 near the liquid receiver L and a expansion valve Ja is disposed at a portion of the pipe P8 near the check valve arrangement Q. The drier D is employed to remove water and debris. The expansion valve Ja is a sort of a restrictor, and is therethrough. The expansion valve Ja is connected through a connection pipe J1 to a temperature sensing tube element for a controlling operation and is also connected to an end of a pressure line J2. A restriction ration of the valve Ja is designed to be controlled in accordance with pilot pressures from the connection pipe J1 and the pressure line J2. Said temperature sensing tube element is arranged in the pipe P6 extending from said valve V. Other end of the line J2 is connected to an inlet formed at the pipe P6 for introducing the pilot pressure.

An inlet of a pipe P9 is connected to a portion of the pipe P8 between the drier D and the expansion valve Ja. An electro-magnetic valve S1 is disposed at the pipe P9. The other end of the pipe P9 is connected to the waste heat reclaimer U. An outlet pipe P10 of the reclaimer U is connected to an intermediate portion of an inlet pipe 12 of the compressor C2. An expansion valve Jb is disposed at a portion of the pipe P9 between the valve S1 and the reclaimer U. The expansion valve Jb has a structure similar to said expansion valve Ja, and is connected through a connection pipe J5 to a temperature sensing tube element provided at the pipe P10.

An inlet of said pipe 12 is connected to an outlet of the pipe P6. Said outlet of the pipe 6 is connected to the inlets of the compressors C1 and C2 through a pipe 11 and said pipe P12, respectively. An electromagnetic valve S2 is arranged at a portion of the pipe P12 between the pipe P6 and the pipe P10. An accumulator A is disposed at an intermediate portion of the inlet pipe 11 for the compressor C1.

Said parts and elements are adapted to be controlled by a control device (not shown) to operate as follows.

In an ordinary heating operation, the electromagnetic valve S1 is open and the electromagnetic valve S2 is closed. A hot compressed gas of a cooling medium which is compressed by the compressors C1 and C2 flows through the pipes P1 and P2, the pipes P3, the four-way valve V and the pipe Py to the heat exchanger KO, and liquefies after radiating the heat when it flows through the heat exchanger KO. Then, the cooling medium flows through the pipe Px, the check valve arrangement Q, the pipe P7 and the liquid receiver L to the pipe P8.

A part of the medium in the pipe P8 flows through the check valve arrangement Q and the pipe P5 to the heat exchanger K. While the medium flows in the heat exchanger K, it is heated by an air supplied by the fans F1 and F2, which are hotter than the medium, and gasifies. This gasified medium flows from the pipe P4 through the four-way valve V, the pipes P6 and P11 to the compressor C1, and is compressed in the compressor C1.

Other medium in the pipe P8 flows through the pipe P9 to the waste heat reclaimer U. While it flows through the reclaimer U, it is heated by a hot cooling water of the engine and gasifies. This medium flows through the pipes P10 and P12 to the compressor C2.

In an ordinary cooling operation, the electromagnetic valve S1 is closed and the electromagnetic valve S2 is open. The hot compressed gas of the cooling medium which is compressed by the compressors C1 and C2 flows through the pipes P1 and P2, the pipes P3 and the four-way valves V to the heat exchanger K. The medium is cooled by the air from the fans F1 and F2 and liquefies when it flows through the heat exchanger K. Then, the liquid medium flows to the check valve arrangement Q. The medium flows from the arrangement Q through the pipe P7 and the liquid receiver L to the pipe P8 and returns to the check valve arrangement Q. The medium passed through the arrangement Q flows through the pipe Px to the heat exchanger KO. While the medium flows through the exchanger KO, it gasifies and cools the air from the blower B. The gasified medium passed through the exchanger KO flows through the pipe Py, the four-way valve U, the pipe P6 and the pipes P11 and P12 to the compressors C1 and C2.

In said heating operation, when the temperature of the cooling water in the circulating passages W is in a predetermined range, the thermostat T1 opens the bypass passage W1, so that the hot cooling water is supplied to the heat reclaimer U. When the temperature of the cooling water is lower than a predetermined value, the thermostat T1 closes the bypass passage W1 to prevent the water from flowing into the heat reclaimer U, so that the heat in the water is not deprived in the heat reclaimer U, which prevents the water from overcooling the engine E.

The electromagnetic valves S1 and S2 may be utilized instead of the the thermostat T1 as described below, in which case the thermostat T1 can be eliminated. That is; when the temperature of the cooling water is lower than the predetermined value, the valve S1 is closed and the valve S2 is opened to prevent the medium from flowing into the heat reclaimer U, so that the heat exchanging operation stops in the reclaimer U. In this case, the medium flows from the pipe P6 through the pipe P12 to the compressor C2.

When the operation is suddenly switched from the cooling mode to the heating mode, the medium of the liquid form, which was flowing through the the heat exchanger K during the cooling operation, flows into the pipe P4. If the liquid medium flowed into the compressors C1 and C2, they would be broken, because the liquid is generally incompressible.

In order to avoid this, the illustrated system is designed as follows. On switching from the cooling mode or heating mode, the compressor C1 initially starts, and after a constant time, the compressor C2 starts. Whereby, at the start of the operation, the medium initially flows only to the compressor C1 through the pipes P6 and P11. Therefore, the liquid medium is caught by the accumulator A, and only the medium of the gas form is supplied to the compressor C1. Of course, when the compressor C2 starts, there is not liquid in the medium flowing from the heat exchanger K to the pipe P6. The start and stop of the compressors C1 and C2 are controlled by said electromagnetic clutches assembled to the drive shafts of the compressors C1 and C2.

Similar operation is performed in the defrosting mode. The defrosting operation is performed to melt the frost formed on the heat exchanger K by the hot medium, so that the liquid medium cooled by the heat exchanger K flows into the pipe P6. In the defrosting operation, only the compressor C2 is driven. After the defrosting operation, the compressor C1 starts, and the liquid medium condensed in the heat exchanger K is caught by the accumulator A.

Detailed structures will be described hereinafter.

Figure 9:
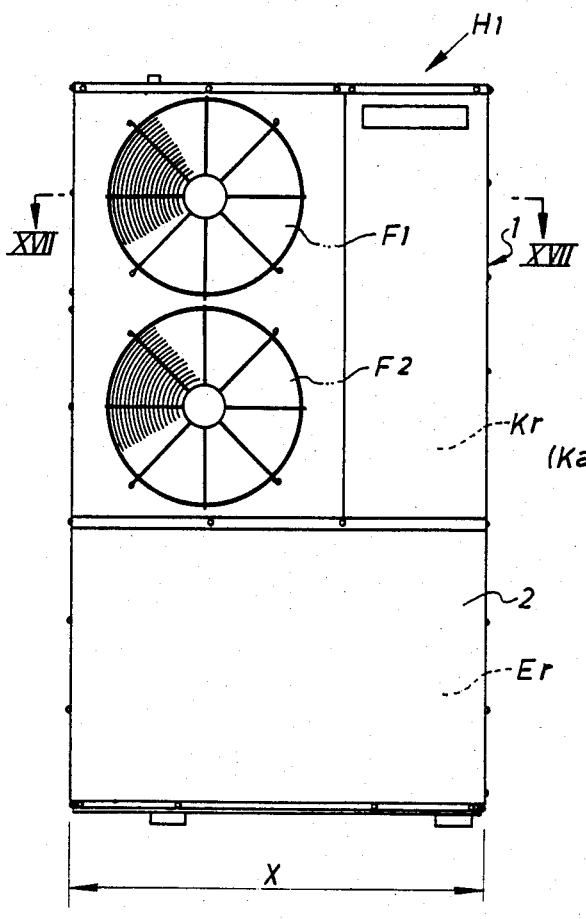
FIG. 9 is a front view of an outdoor unit in FIG. 7.
Figure 10:
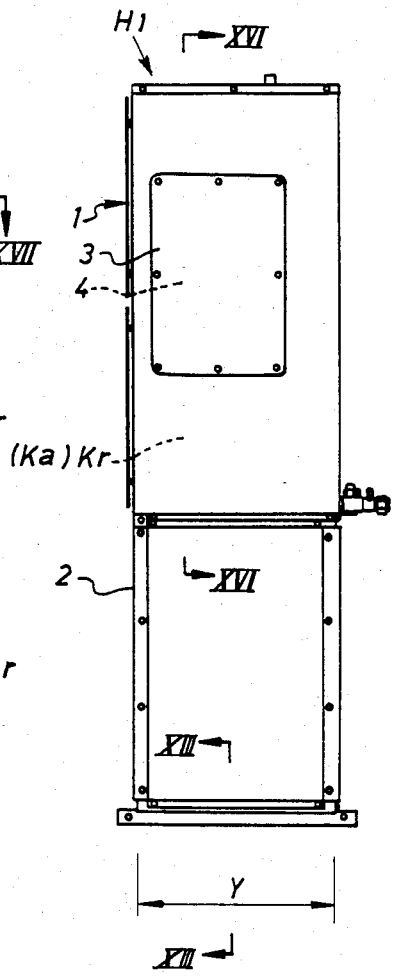
FIG. 10 is a side view of the outdoor unit in FIG. 7.

As shown in FIGS. 9 and 10, the whole outdoor unit H1 has a long width X and a short depth Y. An engine room Er is formed in the lower half of the unit H1, and a heat exchanger room Kr is formed in the upper half thereof. Said fans F1 and F2 is vertically aligned in the room Kr. A cover or a package 1 is provided with openings for ventilation and blasting by the fans F1 and F2.

As will be described later, the package 1 consists of panels, columns of angle steel and reinforcements which are assembled together. A front panel 2 (FIG. 9) covering the front of the engine room Er can be removed for inspection and maintenance, A right side panel (FIG. 10) of the heat exchanger room Kr is provided at its vertically middle portion with an inspection opening 4 which is covered by a removable cover 3.

Figure 11:
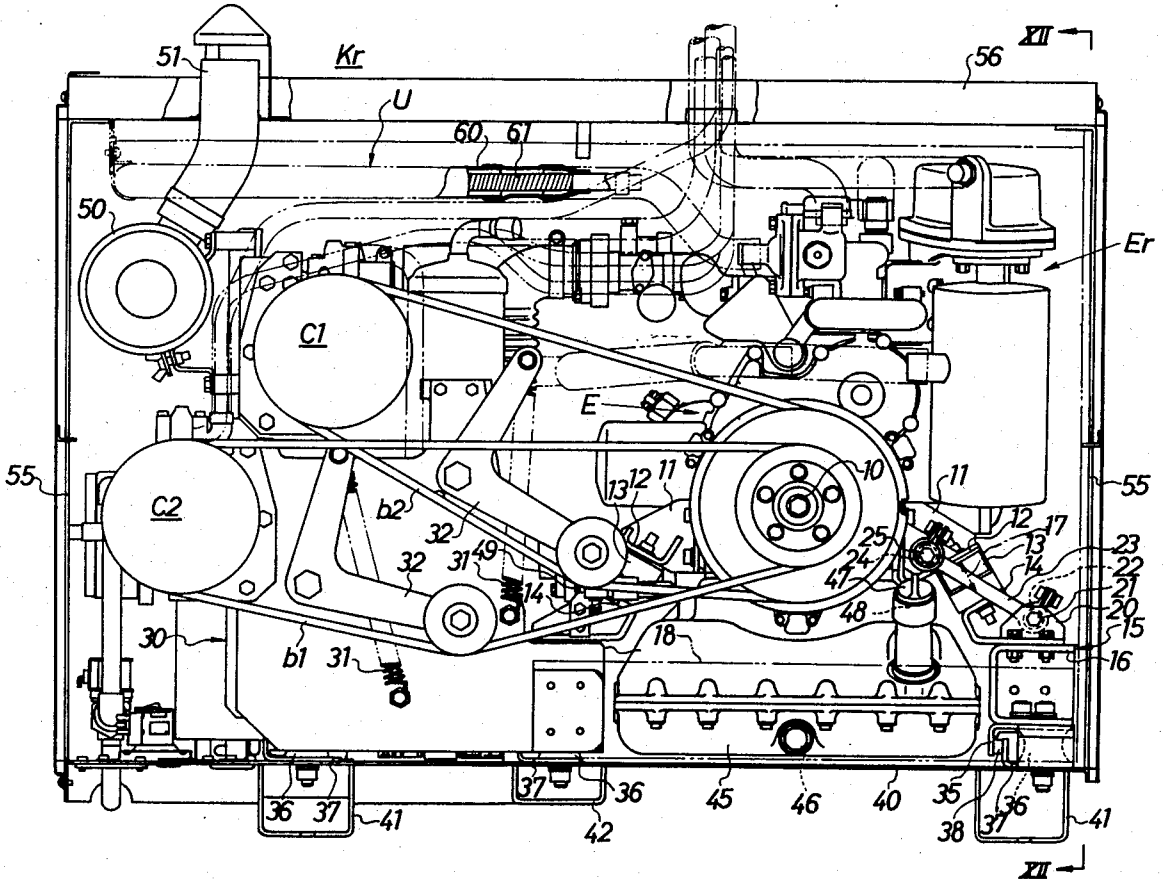
FIG. 11 is a schematic front view of an engine room of the outdoor unit.

Refering to FIG. 11, the engine E is mounted at a rather right portion in FIG. 11 and an output shaft 10 thereof extends front-to-rear direction, i.e., perpendicularly to the front panel 2. The compressors C1 and C2 are aligned obliquely and vertically in a rather left portion of the engine room Er.

The engine E is provided with stays projected from lower portions of four corners of an engine block. Brackets 12 are arranged at the lower ends of the stays 11, respectively. Soft rubbers 13 are fixed to inclined lower surfaces of the brackets 12, respectively. The lower surfaces of the rubbers 13 are fixed to inclined upper surfaces of brackets 14, respectively, of which lower portions are fixed on a pair of longitudinal members 16 of a common mounting bed 15. The members 16 extend in a front-to-rear direction, i.e., parallel to the output shaft 10. The front ends and rear ends of the members 16 are connected by cross members 18, respectively. Thus, the members 16 and 18 form a square frame.

Another brackets 20 are fixed on the longitudinal members 16. Bolts 21 which are parallel to the output shaft 10 are fixed to the brackets 20. Cylindrical ends of torque rods 23 are connected to the outer peripheries of the bolts 21 with a cylindrical rubbers 22 therebetween, respectively. The torque rods 23 extend from the bolts 21 toward a center line of gravity of the engine E, which occupies a position slightly above the output shaft 10 and extend parallel thereto, or toward a line near said center line, The torque rods 23 are provided at their other ends with cylindrical portions, which are connected to the outer peripheries of bolts 25 which are parallel to the bolts 21 with cylindrical rubbers 24 therebetween, respectively. The bolts 25 are fixed to stays of the engine block. The expansion directions of said rubbers 13 are inclined slightly upwardly with respect to the torque rods 23.

Said compressors C1 and C2 are mounted on a compressor flame 30. Tension is applied to said belts b1 and b2 by tensioners 32 which are provided with springs 31 and mounted on the compressor frame 30. The longitudinal member 16 which is located at the near of the left end of the engine E is assembled in a bottom right portion of the compressor frame 30.

As clearly illustrated at a right end portion of FIG. 11, brackets 35 are fixed to lower surfaces of two portions of each longitudinal member 16 and of one portion of left side of the compressor frame 30. A lower surface of each bracket 35 is supported by a bracket 37 with a vibration isolating hard rubber 36 therebetween. Horizontally compressible rubbers 38 are interposed between vertical portions of the brackets 35 and 37, respectively.

A numeral 40 indicates a bottompalte of the engine room Er. A pair of installation legs 41, which are located under the right and left end brackets 37 and extend parallel to the output shaft 10, are fixed to the lower surface of the bottom plate 40. A reinforcement member 42, which is located under the middle bracket 37 and is parallel to the leg 41, is fixed to the lower surface of the bottom plate 40.

According to the above structures, vibration of the engine E is absorbed by the rubbers 13 and is hardly transmitted to the members 16 and the compressor frame 30. Therefore, vibration of the compressors C1 and C2 are effectively prevented. Although the compressors C1 and C2 generate weak vibration, the vibration transmitted from the compressors C1 and C2 to the compressor frame 30 is absorbed by the vibration isolating rubbers 36.

In the above structures, the tensioners 32 apply the tension through the belts b1 and b2 to the engine E.

Therefore, if the engine E were moved toward the compressors C1 and C2 by this tension, the rubbers 13 would deform largely, and thus, the the rubbers 13 would not achieve an intended vibration absorbing effect. However, in the embodiment described above, the torque rods 23 pull the engine E oppositely to the belts b1 and b2, so that the rubbers 13 do not substantially receive the tension by the belts b1 and b2, and thus, the rubbers 13 can achieve the intended effect for absorbing the vibration. Further, the vibration of the engine causes rolling around the center line of gravity. However, since the torque rods 23 extend substantially toward said center line of gravity. Therefore, the rolling is not affected by the torque rods 23, and thus, the rubbers 13 can achieve the intended effect for absorbing the vibration.

In the above structures, the output shaft 10 is arranged perpendicularly to the widthwise direction of the outdoor unit H1, which has the long width. Therefore, the outdoor unit H1 is installed stably with respect to the vibration and the rolling of the engine E. This also prevents or restrict the vibration of the outdoor unit H1 by the rolling of the engine E.

As described before, the longitudinal and cross members 16 and 18 form the square frame. An oil pan 45 of the engine E is disposed in said sqaure frame. The oil pan 45 is provided at the front lower portion with a drain port 46, which is closed by a bolt. The oil pan 45 is also provided at the front upper portion with an oil supplying opening 48, which projects obliquely upwardly toward the front side and is closed by a plug 47. Said belts b1 and b2 as well as the pulleys and tensioners 32 are also arranged at the front end of the engine room Er. An end of a drain pipe 49 for the cooling water which is projected from a body of the engine E is disposed near and under the upper tensioner 32. In a draining operation of the cooling water, a hose (not shown) is connected to the drain pipe 49 and a cock is opened.

An air cleaner 50 of the engine E is arranged at a position above the compressor C2, i.e., left and above the compressor C1. The air cleaner 50 is so adapted that a cleaner element therein can be exchanged by removing a cap thereof. An inlet passage 51 of the air cleaner 50 extends upwardly to the heat exchanger room Kr, and an outlet passage (not shown) thereof extends toward an intake manifold of the engine E.

According to the above structures, the tensioners 32, the oil supplying opening 48, the end of the drain pipe 49, the air cleaner 50 are situated at the front side of the unit. The outdoor unit H1 is usually installed in such a position that the rear and side surfaces thereof are close to walls or the like of a building, and a large space is kept in front of the unit H1 for the blowout from the fans F1 and F2. Therefore, by removing the front panel 2, maintenance and inspection works such as oil supplying, draining of the cooling water, adjusting of the tension of the belts and inspection and exchange of the air cleaner element can easily be performed through said large front space. Although the drain port 46 is positioned behind the cross member 18, the cross member 18 can easily be removed only by removing bolts at both ends thereof. Therefore, the drain port 46 can easily be exposed at the front side, and thus, draining of the oil through the port 46 can also performed easily.

Further, since the engine E can be pulled out to the front space, as described below, the maintenance and inspection of the engine E can also be performed easily. In order to pull out the engine E, set bolts of the brackets 14 are removed to disengage the brackets 14 from the longitudinal members 16 and the front cross member 18 is disengaged from the members 16. The belts b1 and b2 are also removed. Then, the whole engine E is pull out to the front side while sliding the brackets 14 on the longitudinal members 16, so that only the engine E can be taken out while remaining the compressors C1 and C2 inside the room, i.e., without disengaging the pipes for the cooling medium.

Structures described below facilitate a built-in work of the engine E in an assembling work.

Vertical columns 55 made of angle steel are welded and fixed at their lower ends to the four corners of the bottom plate 40. Said front panel 2 (FIG. 9) and other panels for the engine room are fixed to the columns 55 by bolts and others. A top wall 56 is bolted to the upper ends of the columns 55. The top wall 56 is formed by a bent plate and forms a bottom wall of the heat exchanger room Kr.

According to these structures, heavy parts and members such as the engine to be set in the room Er can be set in the engine room Er through an upper opening thereof before the upper wall 56, the front panel 2 and others are fixed to the columns 55.

Figure 12:
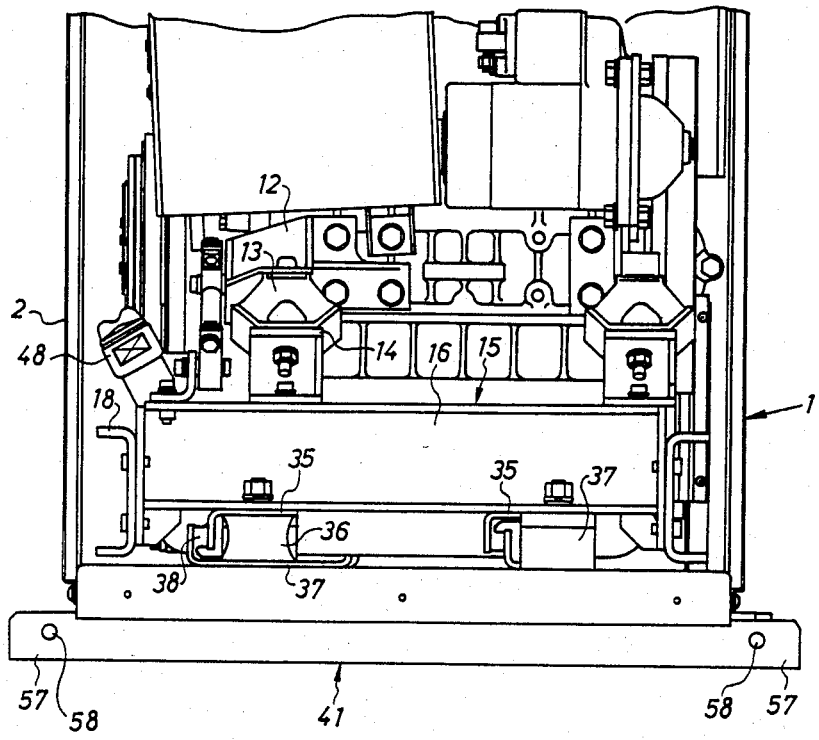
FIG. 12 is a schematic fragmentary sectional view taken along line XII—XII in FIG. 11.

The completed outdoor unit H1 can be conveyed easily as described below. As shown in FIG. 12, said installation legs 41 project forwardly and rearwardly from the package 1 and are provided at their projected ends 57 with ports 58. Therefore, the whole outdoor unit H1 can be easily lifted by wires (not shown) inserted through the ports 58 to convey it.

Then, said waste heat reclaimer U will be detailed. As shown in FIG. 11, the heat reclaimer U is disposed at an upper portion of the engine room Er near the top wall 56 and extends horizontally and substantially in a U-shape. The heat reclaimer U is formed by double tubes consisting of an outer tube 60 and a corrugated inner tube 61. A space between the outer and inner tubes 60 and 61 forms a passage for the cooling water and a space inside the inner tube 61 forms a passage for the cooling medium.

The air heated by the engine E and others circulates in the engine room Er, and thus, the temperature is high in the upper portion of the engine room Er. On the other hand, in the heating operation, the heat reclaimer U heats the cooling medium in the inner passage by the cooling water flowing in the outer passage. Therefore, the outer tube 60 is covered by the hot air in the upper portion of the engine room Er, and thus, the cooling water in the outer tube 60 is kept at a sufficiently hot temperature, so that the cooling medium is sufficiently heated by the hot cooling water.

Figure 14:
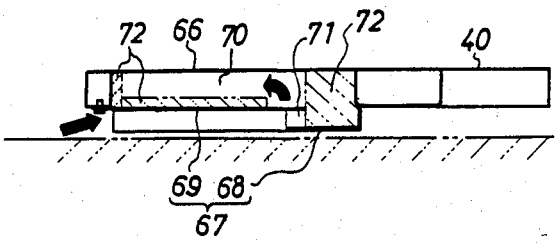
FIG. 14 is a schematic sectional view taken along line XIV—XIV in FIG. 13.
Figure 13:
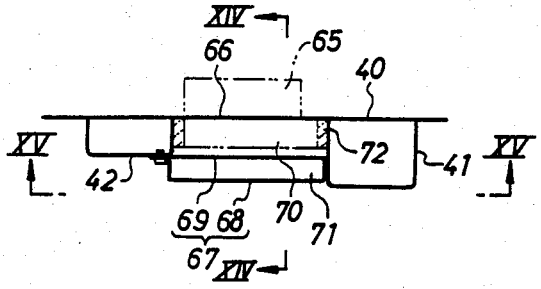
FIG. 13 is a schematic sectional view taken along line XIII—XIII in FIG. 10.
Figure 15:
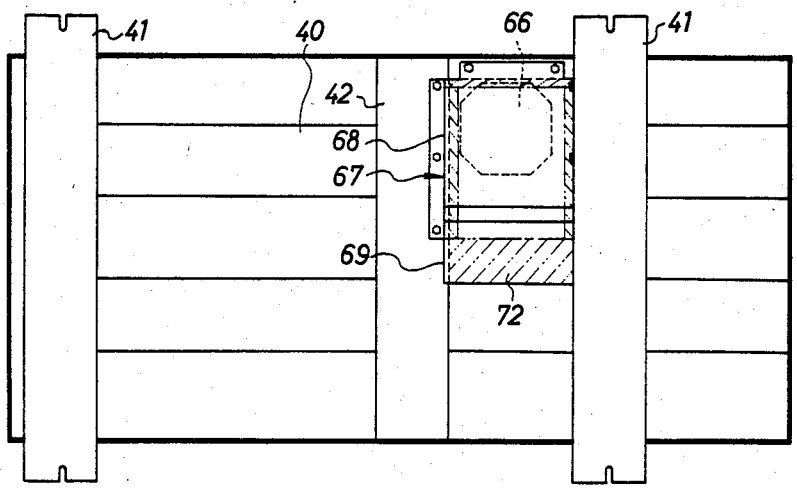
FIG. 15 is a schematic view taken along line XV—XV in FIG. 13.

The engine room Er is substantially sealingly closed for noise insulation and for preventing entrance of the rain and window. However, if the engine room Er were completed sealed, the inside temperature would become too hot, which would cause troubles in electric parts, especially for ignition of the engine. Therefore, as shown in FIGS. 13 to 15, a ventilation fan 65 is arranged at the bottom of the engine room Er.

The ventilation fan 65 is arranged on the bottom plate 40, which is provided with an opening 66 for the ventilation. The opening 66 is situated between the reinforcement member 42 and the installation leg 41 near the compressors and is covered from its lower side by a cover 67. The cover 67 is formed by a bent plate and is bolted to said members 41 and 42. The cover 67 consists of a wall 68 extending forwaldly (toward the right in FIG. 14) beyond the opening 66 and a wall 69 positioned at the rear of the wall 68. The wall 69 extends horizontally under the opening 66 and forms a passage 70 therebetween. The wall 68 projects downwardly beyond the wall 69 and forms a passage 71 above the lower rear portion thereof, which opens rearwardly. Therefore, the outside air flows upwardly through the passage 71 into the passage 70 and flows through the passage 70 to the opening 66. A noise-proofing member 72 is attached to the inner surface of the wall 69. The noise-proofing member 72 is also filled inside the front part of the wall 68.

Figure 16:
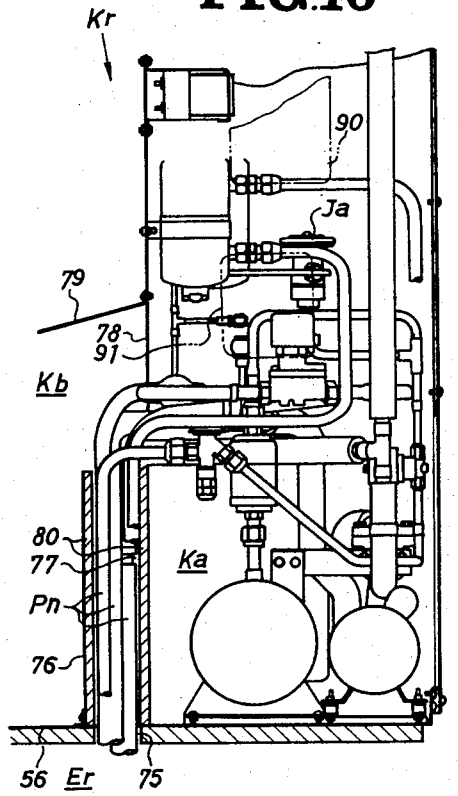
FIG. 16 is a schematic sectional view taken along line XVI—XVI in FIG. 10.
Figure 17:
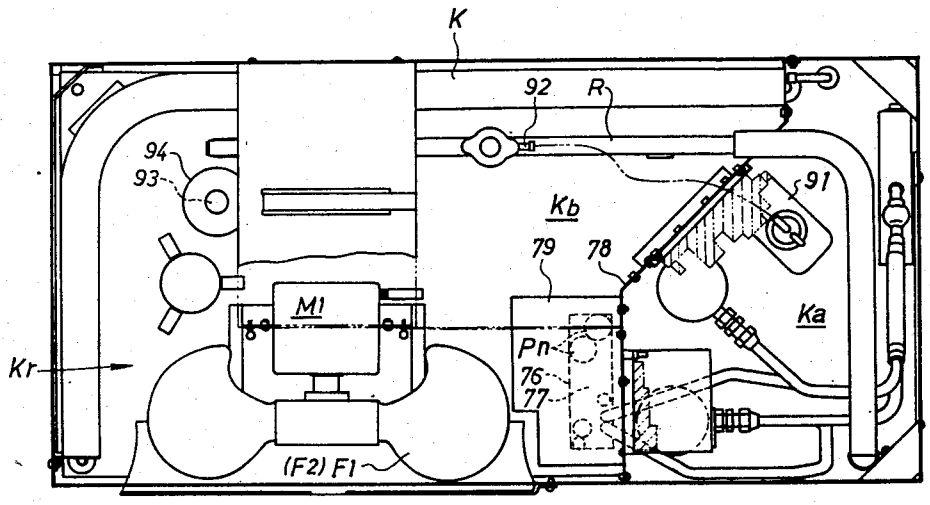
FIG. 17 is a schematic sectional view taken along line XVII—XVII in FIG. 9.

The air taken into the engine room Er by the ventilation fan 65 is discharged through an opening 75 in FIGS. 16 and 17 to the heat exchanger room Kr. As shown in FIG. 16, the opening 75 is formed at the top wall 56 of the engine room Er, which is a bottom wall of the heat exchanger room Kr. A lower end of an upwardly extending ventilation duct 76, in which a ventilation passage 77 is formed, is fixed to the periphery of the opening 75 in the wall 56. 78 indicates a partition wall which partitions the heat exchanger room Kr into two rooms Ka and Kb. The ventilation duct 76 is disposed closely to the wall 78 in the room Kb. Since the room Kb accommodates said fans F1 and F2 (FIG. 17), the rain may enter the room Kb. Therefore, a hood 79 covering the upper side of the passage 77 is fixed to the wall 78 so as to prevent the rain from entering the engine room Er through the passage 77.

The passage 77 functions as a space for the ventilation as well as a space through which pipes Pn for the cooling medium and electric wires. The pipes Pn and electric wires connect the equipments and devices in the engine room Er and the room Ka together. The pipes Pn and wires are bent after extending upwardly through the passage 77 and extend through opening into the room Ka.

A noise absorbing member 80 is attached to the inner surface of the ventilation duct 76. Although not clearly illustrated, sponge-like buffer members are attached around the pipes Pn.

As shown in FIG. 16, a controller 90 such as a microcomputer or a relay equipment is disposed at the upper portion of the room Ka. Said expansion valve Ja and a reserve tank 91 for the radiator R are disposed at the vertically middle portion of the room Ka. As shown in FIG. 17, the reserve tank 91 is connected to an overflow pipe 92 at the upper end of the radiator R, so that the cooling water overflowing the radiator R is collected in the tank 91 and is properly returned to the radiator R.

As shown in FIG. 10, said inspection opening 4 is formed at the middle portion of the right side wall of the room Ka. Therefore, by opening the opening 4, the controller 90, reserve tank 91, expansion valve Ja and others near the opening 4 can be operated and inspected easily.

As shown in FIG. 17, the heat exchanger K is disposed in the room Kb and extends along a rear wall and a left side wall of the room Kb. An exhaust pipe 93 is disposed at the rear of the fan F1 and at the forward of the heat exchanger K. The exhaust pipe 93 extends upwardly from the lower engine room Er (FIG. 11) and is provided at the upper end with a mist separator 94. The mist separator 94 functions to condense the mist and moisture in the exhaust gas and catch them to achieve following effect.

When the engine is the gas engine, the exhaust gas of the engine contains strongly acid moisture. Therefore, if the exhaust gas were discharged to the cold atmosphere without treating it, the moisture would condense in the atmosphere into strongly acid water droplets, which might cause corrosion of external equipments. The mist separator 94 is employed to prevent the above problems. In the illustrated embodiment, when the atmosphere is cold, i.e., when the heating operation is performed, the mist separator 94 can be cooled by the very cold air which is cooled by the heat exchanging in the heat exchanger K, because the mist separator 94 is arranged between the fan F1 and the heat exchanger K. Therefore, a condensing efficiency, i.e., an efficiency for catching the moisture, is improved.

The water caught by the mist separator 94 is discharge to an external device (not shown) through a pipe (not shown) and is treated therein.

Figure 18:
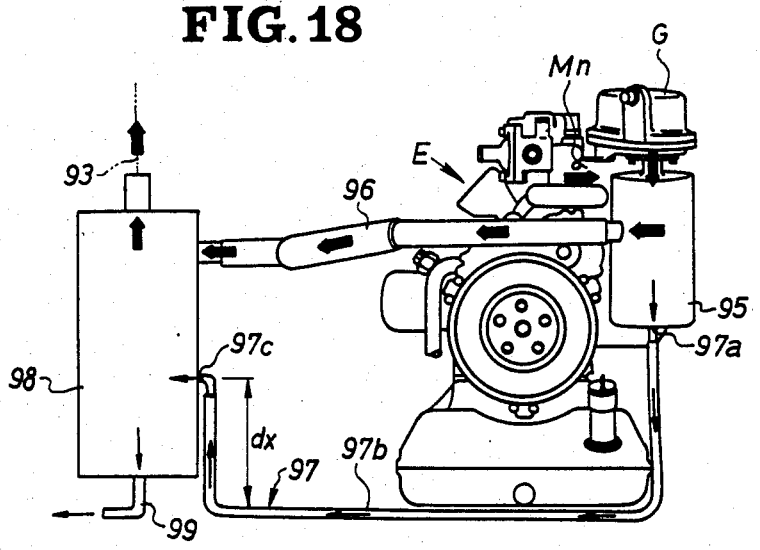
FIG. 18 is a schematic front view of an exhaust arrangement of an engine.

As shown in FIG. 18, the exhaust port or ports of the engine E is connected through the manifold Mn and the waste heat exchanger G to an upper end of a first muffler 95, which has a vertically extending cylindrical form. Upper and lower portions of the muffler 95 are connected to upper and lower portions of a second muffler 98 through pipes 96 and 97, respectively. The second muffler 98 has a vertically extending cylindrical form. Said exhaust pipe 93 extends upwardly from the upper end of the second muffler 98. A drain pipe 99 for the water extends from the bottom of the muffler 98 to an external neutralization device (not shown).

Said pipe 96 extends substantially horizontally. The exhaust gas flows from the first muffler 95 through the pipe 96 to the second muffler 98. The pipe 97 is of substantially U-shape. the upper end of the pipe 97 forms an inlet **97*a* connecting to the first muffler 95. A middle portion 97*b* of the pipe 97 which extends substantially horizontally occupies the lowest position. An outlet 97*c* of the pipe 97 connected to the second muffler 98 is higher by a distance dx than the middle portion 97*b***.

In these structures, the pipe portion of the pipe 97 lower than the outlet **97*c* forms a water trap, which collects the water in the exhaust gas condensed in the first muffler 95. The collected water flows from the pipe 97 to the second muffler 98, when the condensed water further flows into the pipe 97 or an exhaust pressure higher than a water column corresponding to the height dx is applied into the pipe 97. The water flowed into the muffler 98 is discharged together with the water condensed therein to the pipe 99**.

Figure 19:
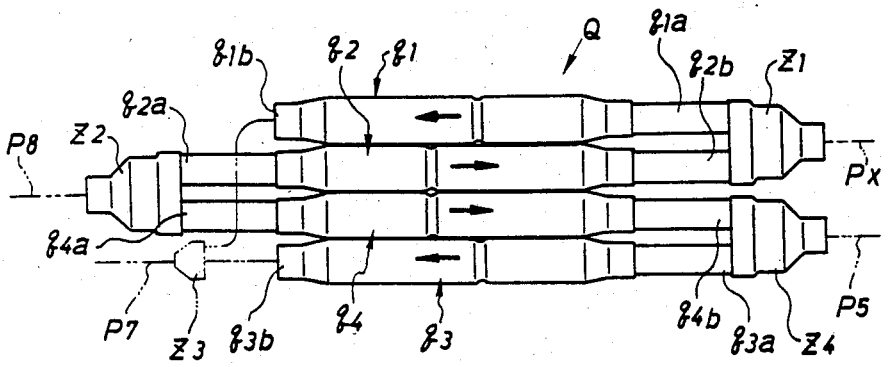
FIG. 19 is a schematic front view of a check valve arrangement.

The check valve arrangement Q in FIG. 7 will be detailed with reference to FIG. 19. The check valve arrangement Q is formed by an assembly of four check valves q1 to q4. Each of the check valves q1 to q4 has a substantially cylindrical form, and includes a movable valve body (not shown) adapted to allow flowing of the fluid only in one direction.

An inlet q1*a* of the valve q1 and an outlet q2*b* of the valve q2 are connected through a Y-shaped joint Z1 to said pipe Px. An outlet q1*b* of the valve q1 and an outlet q3*b* of the valve q3 are connected through a Y-shaped joint Z3 to said pipe P7. An inlet q2*a* of the valve q2 and an inlet q4*a* of the valve q4 are connected through a Y-shaped joint Z2 to said pipe P8. An outlet q4*b* of the valve q4 and an inlet q3*a* of the valve q3 are connected through a Y-shaped joint Z4 to said pipe p5.

Said parts of the arrangement Q are connected together through the ends thereof which are fitted and fixed together. In the illustrated embodiment in FIG.

19, the four check valves q1 to q4 are arranged parallel to each other and on a same plane. However, this arrangement can be changed into various forms.

According to the structures in FIGS. 7 to 19, the start of the second compressor C2 is delayed to that of the first compressor C1 by the control device such as a timer (not shown) and electromagnetic clutches so that the liquefied medium may not flow into the inlet pipe P12 of the second compressor C2. Therefore, the accumulator A is required only in the inlet pipe P11 of the first compressor C1, resulting in the the simple structures of the accumulator arrangement.

The delayed start of the second compressor C2 also achieves such an advantage that starting load applied to the engine E can be reduced substantially by half, and thus, driving condition when the load starts to be applied by the compressor can be stable.

The thermost T1 or the electromagnetic valves S1 and S2 form control means, which stop the heat changing operation in the waste heat reclaimer when the temperature of the engine is lower than the predetermined value. Therefore, over-cooling of the engine can be prevented, and thus, the durability, combustion condition and power loss can be improved. Blowby gas can also be reduced.

As shown in FIG. 7, the cold cooling water discharged from the radiator R is immediately supplied to the exhaust gas heat exchanger G, so that there is a large difference between the temperatures of the exhaust gas and the cooling water. Therefore, the exhaust gas heat exchanger G has a large heat exchanging efficiency, and can be smaller than a conventional structure.

The jointing structures of the first to fourth check valves q1 to q4 are improved, and the check valve arrangement can have a simple structure suitable for the heat pump.

In the illustrated embodiment, the check valves have cylindrical structures and the joints have Y-shaped structures. The check valve arrangement having these structures can be especially compact and have a lower resistance in the pipes against the flow, i.e., the fluid can flows more smoothly than other joints.

Although the invention has been described in its preferred form with a certain degree of particularity, it is understood that the present disclosure of the preferred form may been changed in the details of construction and the combination and arrangement of parts may be resorted to without departing from the spirit and scope of the invention as hereinafter claimed:

What is claimed is:

1. An outdoor unit of an air conditioner of an engine heat pump type comprising an engine; first and second compressors driven by the engine and having substantially same capacity and heat exchangers for the compressors, said heat exchanger for the first compressor being adapted to utilize an atmosphere as a heat source in a heating operation, said heat exchanger for the second compressor being adapted to utilize a waste heat of the engine as a heat source in the heating operation, a rotation speed of the second compressor being set smaller than that of the first compressor in the heating operation, only the second compressor is adapted to operate in a defrosting operation for the heating operation while utilizing the waste heat of the engine as the heat source, said compressors being adapted to operate in a cooling operation and a rotation speed of the engine and a number of the compressors to be operated being controlled so as to control a cooling capacity in the cooling operation.

2. An outdoor unit of an air conditioner of an engine heat pump type comprising an engine; first and second compressors driven by the engine; a heat exchanger for heat exchanging between an atmosphere and a cooling medium; a waste heat reclaimer arrangement operable to heat the cooling medium by a waste heat of the engine; a control passage arrangement operable to connect said heat exchanger to inlet passages of both compressors in a cooling operation and to connect said heat exchanger and said waste heat reclaimer arrangement to the inlet passage of the first compressor and the inlet passage of the second compressor in a heating operation, respectively; control means operable to delay a start of the second compressor with respect to a start of the first compressor and an accumulator arranged only in the inlet passage of the first compressor among the inlet passages of the compressors.

3. An outdoor unit as claimed in claim 2 wherein said waste heat reclaimer arrangement includes a waste heat reclaimer and passages for cooling water of the engine and the cooling medium connected to the waste heat reclaimer and control means are associated to the waste heat reclaimer so as to stop heat exchanging in the waste heat reclaimer when a temperature of the engine is lower than a predetermined value.

4. An outdoor unit as claimed in claim 3 wherein said control means for the waste heat reclaimer include a thermostat provided in the passage for the cooling water of the engine.

5. An outdoor unit as claimed in claim 3 wherein said control means for the waste heat reclaimer include a valve provided in the passage of the cooling medium.

6. An outdoor unit as claimed in claim 2 wherein a passage arrangement includees first to fourth passages for the cooling medium and a check valve arrangement which comprises first to fourth check valves, a first joint connecting an inlet of the first valve and an outlet of the second valve to the first passage, a second joint connecting an inlet of the second valve and an inlet of the fourth valve to the second passage, a third joint connecting an outlet of the first valve and an outlet of the third valve to the third passage and a fourth joint connecting an outlet of the fourth valve and an inlet of the third valve to the fourth passage.

* * * * *